US008680996B2

(12) United States Patent
Foti

(10) Patent No.: US 8,680,996 B2
(45) Date of Patent: Mar. 25, 2014

(54) ALARM LOCK

(75) Inventor: Ivan Foti, Hong Kong (HK)

(73) Assignee: Xena IP Holdings Limited, Tortola (VG)

( * ) Notice: Subject to any disclaimer, the term of this patent is extended or adjusted under 35 U.S.C. 154(b) by 720 days.

(21) Appl. No.: 12/934,971

(22) PCT Filed: Mar. 20, 2009

(86) PCT No.: PCT/GB2009/000767

§ 371 (c)(1),
(2), (4) Date: Nov. 23, 2010

(87) PCT Pub. No.: WO2009/118515

PCT Pub. Date: Oct. 1, 2009

(65) Prior Publication Data

US 2011/0259063 A1 Oct. 27, 2011

(30) Foreign Application Priority Data

Mar. 27, 2008 (GB) ..... 0805601.2

(51) Int. Cl.
*E05B 67/00* (2006.01)

(52) U.S. Cl.
USPC ..... 340/542; 340/541; 340/427; 340/432; 70/344; 70/441; 70/266

(58) Field of Classification Search
USPC ..... 340/542, 541, 426, 426.1, 427, 432; 70/21, 25, 266, 277, 344, 441, 281; 700/281
See application file for complete search history.

(56) References Cited

U.S. PATENT DOCUMENTS

| | | | | |
|---|---|---|---|---|
| 3,879,721 | A * | 4/1975 | Yereance | 70/441 |
| 4,556,872 | A | 12/1985 | Masoncup et al. | |
| 5,005,386 | A * | 4/1991 | Chang | 70/39 |
| 5,381,128 | A | 1/1995 | Kaplan | |
| 5,408,212 | A | 4/1995 | Meyers et al. | |
| 6,043,733 | A * | 3/2000 | Lind | 340/426.28 |
| 2005/0199019 | A1 | 9/2005 | Marcelle et al. | |
| 2006/0150690 | A1 * | 7/2006 | Lai et al. | 70/21 |

FOREIGN PATENT DOCUMENTS

| | | |
|---|---|---|
| EP | 0 413 065 A1 | 2/1991 |
| GB | 2 295 192 | 5/1996 |
| GB | 2 295 639 A | 6/1996 |
| GB | 2 424 918 | 10/2006 |
| WO | 2006/030177 A | 3/2006 |

OTHER PUBLICATIONS

Search Report from corresponding GB Application No. 0805601.2.
International Search Report and Written Opinion of the International Searching Authority completed by the International Searching Authority on Jun. 8, 2009 in connection with International Application No. PCT/GB2009/000767.

* cited by examiner

*Primary Examiner* — Hung T. Nguyen
(74) *Attorney, Agent, or Firm* — Workman Nydegger

(57) ABSTRACT

A lock has a body holding a locking member that can be locked to or released from the body by, for example, operation of a key. The lock includes an alarm that is triggered by the locking of the locking member. If, however, the lock is unlocked and relocked within a predetermined time interval, the alarm is disarmed. In this way, the lock can remain locked but with the alarm disarmed. The signals that cause the alarm to arm and disarm can be produced in any convenient way.

12 Claims, 3 Drawing Sheets

ALARM LOCK

CROSS-REFERENCE TO RELATED APPLICATIONS

This application is a United States National Stage of International Application No. PCT/GB2009/000767, filed Mar. 20, 2009, and claims priority to European Patent Application No. 0805601.2, filed Mar. 27, 2008. All of the aforementioned applications are incorporated herein in their respective entireties by this reference.

BACKGROUND

The invention relates to locks and more particularly to locks incorporating an alarm.

It is known to provide a lock comprising a body and a locking member lockable to the body and unlockable for opening movement relative to the body, the body including an alarm and an alarm trigger operable, when the locking member is locked to the body, to activate the alarm. The alarm trigger can, for example, be operated by a locking movement of a key or the operation of a push-button to lock the locking member.

It is a problem with such locks that, while it is desirable to have the alarm operable when the lock is locking a device against use, there may be occasions when it is required to have the lock member in the locked position but to have the alarm inoperative. This might, for example, be when the lock is being transported. There is a danger that the alarm will operate in such circumstances.

BRIEF SUMMARY OF SOME EXAMPLE EMBODIMENTS

According to the invention, there is provided lock comprising a body and a locking member lockable to the body and unlockable for opening movement relative to the body, the body including an alarm and an alarm trigger operable, when the locking member is locked to the body, in a first mode to activate the alarm and in a second mode to render the alarm inoperative.

Thus, by providing the second mode of operation of the alarm trigger, the lock can have the locking member in the locked position but have the alarm inoperative. The lock can be transported in this configuration without the alarm operating.

BRIEF DESCRIPTION OF THE DRAWINGS

The following is a more detailed description of some embodiments of the invention, by way of example, reference being made to the accompanying drawings in which.

DETAILED DESCRIPTION OF SOME EXAMPLE EMBODIMENTS

Figure 1:
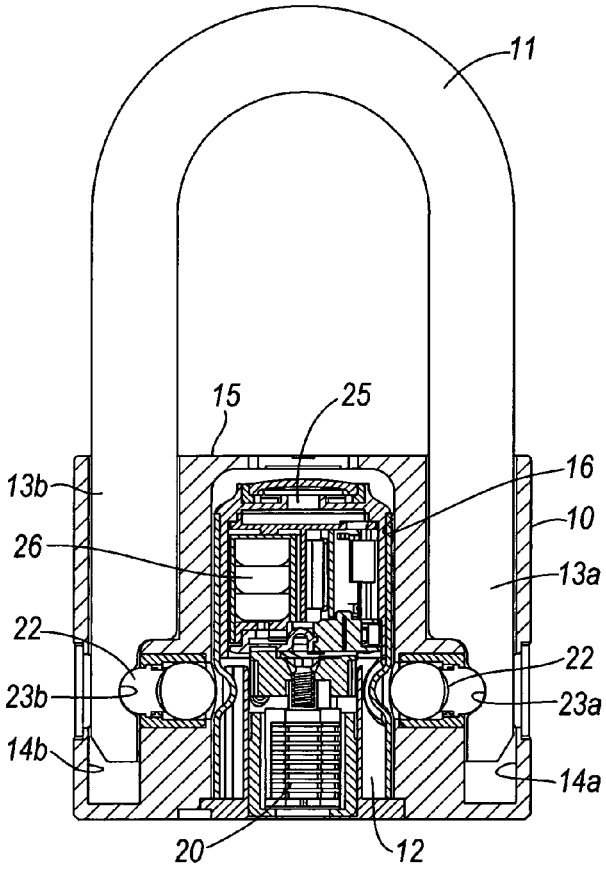
FIG. 1 is a cross-section of a padlock including a body, a locking member and a barrel incorporating an alarm and a control circuit.

Referring first to FIG. 1, the padlock comprises a body 10, a U-shaped locking member 11 and a barrel 12. The locking member 11 has arms 13*a*, 13*b* received in respective passages 14*a*, 14*b* in a first end face 15 of the body 10. The arms 13*a*, 13*b* and the passages 14*a*, 14*b* may be of circular cross-section, but this is not essential.

The barrel 12 is received in a bore 16 in the body 10 extending into the body 10 from a second end of the body 10 and closed at the opposite end. The barrel 12 and the bore 16 may be of circular cross-section. The barrel 12 is formed from two axially spaced parts—a locking unit 17 and an electronics module 18. The locking unit 17 is closer to the open end of the body 10 and the electronics module 18 at the closed end. The locking unit 17 is operated by a key 19 and includes a mechanism 20 that converts rotation of the key 19 in one sense into radially outward movement of two pins 22 held by the body 10 to engage respective recesses 23*a*, 23*b* formed towards respective ends of the arms 13*a*, 13*b* when the arms 13*a*, 13*b* are received in the passages 14*a*, 14*b*. In this way, the locking member 11 is locked to the body 10. Mechanisms of this kind are known and will not be described in further detail.

The electronics module 18 contains a battery 24, an alarm 25 and an alarm control circuit 26. In addition, a switch 27 is carried on an end face of the electronics module 18 and includes a pin 28 that engages the locking mechanism 20 so that rotation of the mechanism moves the pin 28 to operate the switch 27. The switch 27 is connected to the alarm control circuit 26, which is, in turn, connected to the alarm 25. The alarm control circuit 26 and the alarm 25 are powered by the battery 24.

Figure 2:
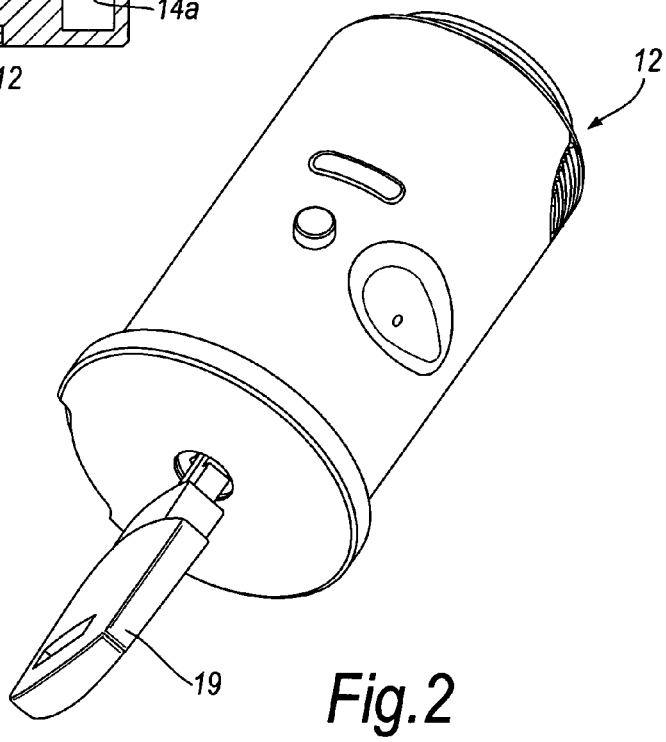
FIG. 2 is a perspective view of the barrel, with a key in the barrel.
Figure 3:
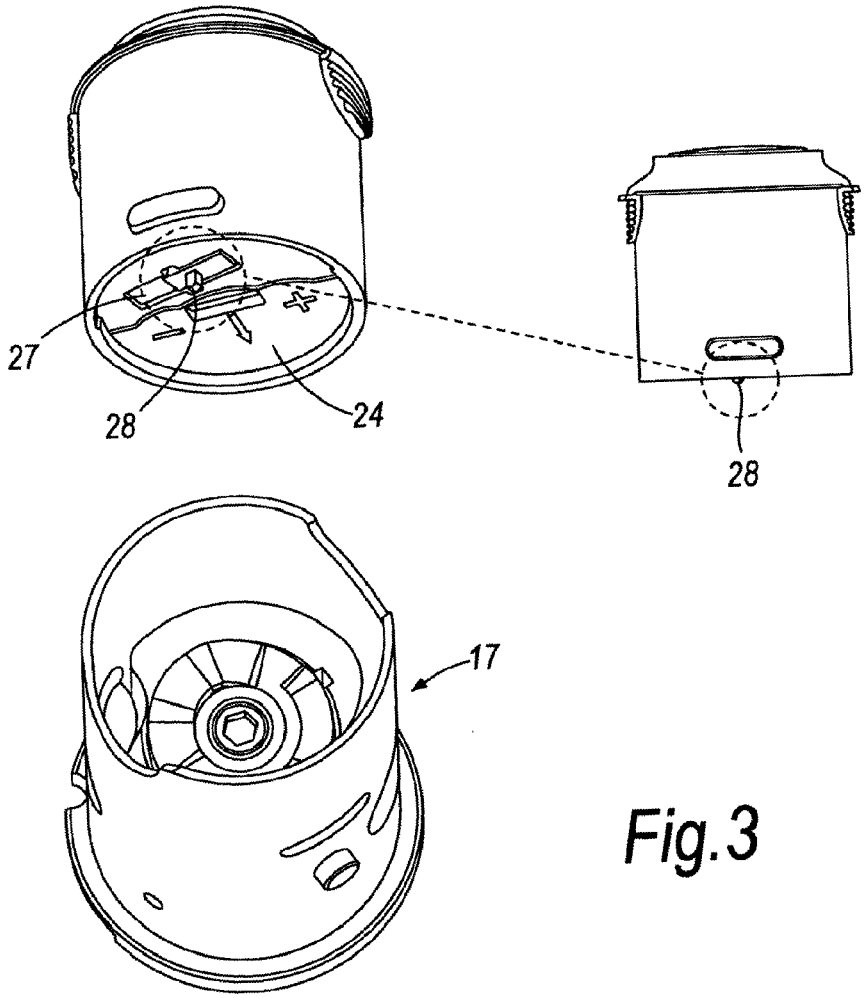
FIG. 3 is an exploded view of the barrel of FIG. 2 showing a locking unit and an electronics module, the electronics module also being shown in side elevation.
Figure 4:
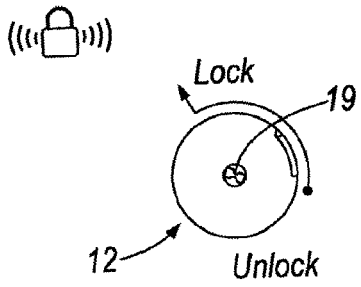
FIG. 4 is a diagram showing the activation of the alarm.

In use, the key 19 is rotated clockwise as seen in FIG. 2 to unlock the locking mechanism 20, so allowing the pins 22 to retract and release the locking member 11 for disengagement from the body 10 by removal of the arms 13*a*, 13*b* from the passages 14*a*, 14*b*. The locking member 11 can then be passed through part of a device to be locked, which might, for example, be a hole in a disc of a disc brake of a motorcycle (not shown) and the arms 13*a*, 13*b* re-inserted into the passages 14*a*, 14*b*. The key 19 is then turned anti-clockwise as seen in FIG. 4. The effect of this is to extend the pins 22 to engage the respective recesses 23*a*, 23*b* of the arms 13*a*, 13*b*, so locking the locking member 11 to the body 10.

This rotation of the key 19 also moves the pin 28 to operate the switch 27. This passes an electrical signal to the alarm control circuit 26 that, in turn, triggers the alarm 25. At the same time, the alarm control circuit 26 emits a short duration sound to indicate to the user of the lock that the alarm 25 is operative.

If nothing further is done after these steps, the alarm 25 remains armed and will operate if there is unauthorised interference with the lock. After a predetermined time interval, which may, for example, be 5 seconds, the alarm control circuit 26 emits a longer duration sound to confirm arming.

Figure 5:
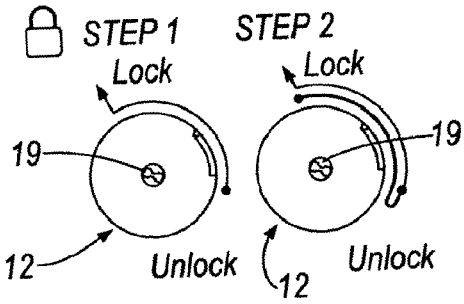
FIG. 5 is a diagram showing the subsequent rendering of the alarm inactive.

If, however, within the predetermined time interval, the key 19 is turned to unlock and re-lock the lock (see FIG. 5), then the switch 27 is operated again and sends an additional signal to the alarm control circuit 26. On receipt of this signal within the time interval, the alarm control circuit 26 renders the alarm 25 inoperative. At the same time, the alarm control circuit 26 emits a two sounds of shorter duration than the duration of the "confirm arming" sound to indicate that the alarm 25 is no longer armed.

Of course, if the unlocking and re-locking takes place outside the time interval, the alarm 25 remains armed.

In this way, the lock can be locked either with the alarm 25 armed or disarmed. The alarm 25 may be disarmed when, for example, the lock is transported or if the lock is used in circumstances where an alarm 25 would be too intrusive.

Of course, there are a number of alterations that could be made to the lock described above with reference to the drawings. The key 19 is but one example of a locking means 21, and the lock need not be operated by a key 19. It could be operated by a push-button, key pad or any other convenient operating mechanism. In the lock described above with reference to the drawings, the lock is armed when a first signal is received by the alarm control circuit 25 and disarmed if an additional signal is received within a predetermined time interval.

These signals need not be generated as described above using a key. They could be generated non-mechanically by any system that produces a first signal to arm the lock and provides a time interval in which generation of a second signal disarms the lock.

For example, the lock might include one or more sensors that produce the first signal when a first condition is detected and to arm the lock and to start a time interval within which generation of the second signal will disarm the lock. The sensor or sensors may, for example, generate the first signal when an "in use" condition is detected.

Figure 6:
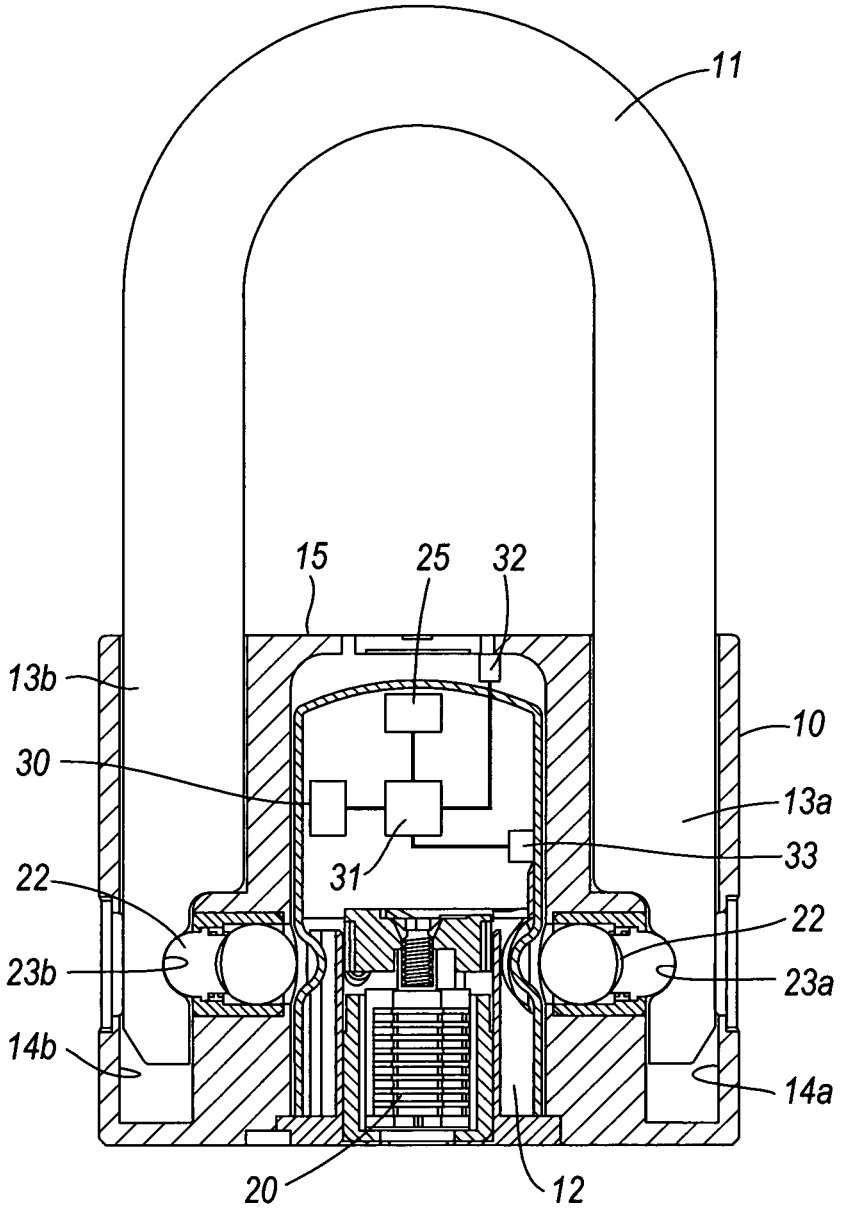
FIG. 6 is a similar view to FIG. 1 but with the control circuit operable by a sensor and/or an infra-red detector.

In the case of a lock for a disc brake of a motor cycle, the "in use" condition may be when the lock is locked to a disc brake. For this purpose, and referring to FIG. 6, the lock may be provided with a shock sensor 30 connected to a control circuit 31 that detects an output of the shock sensor characteristic of the lock being locked to a disc brake to produce the first signal from the claim 25. In another arrangement an infra-red sensor 32 may be provided connected to the control circuit 31. When the control circuit detects a characteristic output of the shock sensor 30, the output of the infra-red sensor 32 is received to determine whether it is characteristic of the presence of a disc brake. If it is, the first signal is produced and the time interval commences for detection of the second signal.

The second signal can, in this embodiment, be provided in any convenient way. For example, where a shock sensor 30 is present, a force may be applied to the lock in the time interval that produces from the sensor 30 a characteristic signal detected by the control circuit 31 to generate the second signal and disable the alarm 25. The force might, for example, be produced by tapping the lock in a particular way and/or at a particular area of the lock surface with the tapping being detected by a detector 33.

The signals need not be provided sequentially. There could be a first signal having a first characteristic to arm the alarm and an alternative second signal that renders the alarm inoperative. These could be produced by the use of two different keys.

The lock does not have to be a padlock of the kind described above. It could be any kind of lock having a body, a locking member that is lockable and unlockable and an alarm that can be armed and disarmed.

The invention claimed is:

1. A lock comprising a body and a locking member lockable to the body and unlockable for opening movement relative to the body, the body including an alarm and an alarm trigger, the lock further comprising locking means operable to lock the locking member to the body and to unlock the locking member from the body, the locking means, as the locking means locks the locking member to the body, causing the generation of a first electrical signal which operates to cause the alarm trigger to activate the alarm, and subsequent operation of the locking means within a predetermined time interval from the generation of the first electrical signal causing the generation of a second electrical signal which operates to cause the alarm trigger to render the alarm inoperable.

2. A lock according to claim 1 wherein the second signal comprises the first signal and an additional signal.

3. A lock according to claim 2 wherein the additional signal is generated by the alarm trigger after the first signal.

4. A lock according to claim 3 wherein the alarm includes an alarm control circuit, the alarm control circuit activating the alarm if only the first signal is received within a predetermined time period and rendering the alarm inoperative if, within said predetermined time period, both the first signal and the additional signal are received.

5. A lock according to claim 3 wherein a first audible signal is provided when the alarm is activated.

6. A lock according to claim 3 wherein a second audible signal is provided when the alarm is rendered inoperative.

7. A lock according to claim 1 wherein the locking means is a key.

8. A lock according to claim 1 wherein the locking means is a push-button.

9. A lock according to claim 1, wherein subsequent operation of the locking means within a predetermined time interval comprises both unlocking the lock and then relocking the lock within the predetermined time interval.

10. A lock, comprising:

a body;

a locking member configured to be removably received in the body and to directly engage an item to be secured with the lock; and a barrel configured to be received in a bore defined by the body, the barrel comprising:

a key-operated locking unit operable to lock the locking member to the body and operable to unlock the locking member from the body; and an electronics module including an alarm and alarm trigger, the electronics module operably disposed with respect to the key-operated locking unit such that:

locking of the locking member to the body causes the generation of a first electrical signal which causes the alarm trigger to activate the alarm; and a subsequent process of both unlocking and relocking of the locking member to the body causes the generation of a second electrical signal when the subsequent process is performed within a predetermined time interval after generation of the first electrical signal, wherein the second electrical signal causes the alarm trigger to render the alarm inoperable even while the locking member remains locked to the body.

11. A lock according to claim 10, wherein the lock comprises a padlock.

12. A lock according to claim 10, wherein when the subsequent process is performed after passage of the predetermined time interval, the alarm remains activated.

* * * * *